US007780147B2

(12) United States Patent
Franks

(10) Patent No.: US 7,780,147 B2
(45) Date of Patent: Aug. 24, 2010

(54) DRAWWORKS HAVING ANNULUS ROTATING UNION WITH BRAKE COOLING SYSTEM

(76) Inventor: Charles Glen Franks, P.O. Box 179, Canyon, TX (US) 79015-0179

( * ) Notice: Subject to any disclaimer, the term of this patent is extended or adjusted under 35 U.S.C. 154(b) by 0 days.

(21) Appl. No.: 12/543,122

(22) Filed: Aug. 18, 2009

(65) Prior Publication Data

US 2010/0038610 A1 Feb. 18, 2010

Related U.S. Application Data

(60) Provisional application No. 61/189,214, filed on Aug. 18, 2008.

(51) Int. Cl.
*B66D 5/08* (2006.01)

(52) U.S. Cl. ..... 254/378; 254/278

(58) Field of Classification Search ..... 254/278, 254/291, 315, 378

See application file for complete search history.

(56) References Cited

U.S. PATENT DOCUMENTS 1,956,188 A * 4/1934 Black ..... 188/264 D
2,468,388 A * 4/1949 Wilson ..... 192/17 R
2,526,525 A * 10/1950 Young ..... 188/264 D
3,901,478 A * 8/1975 Peterson ..... 254/270
3,964,692 A * 6/1976 Pendleton ..... 254/379
3,986,564 A * 10/1976 Bender ..... 173/4
3,991,787 A * 11/1976 Schmitt et al. ..... 137/596.13
4,046,235 A * 9/1977 Shutt ..... 188/134
4,560,048 A * 12/1985 Flotow et al. ..... 192/70.12
6,029,786 A * 2/2000 Sommer ..... 192/18 A
6,668,684 B2 * 12/2003 Allen et al. ..... 81/57.15
7,451,963 B2 * 11/2008 Finkenbusch et al. ..... 254/278
2006/0151265 A1 * 7/2006 Honjou et al. ..... 188/170
2008/0173515 A1 * 7/2008 Daigre ..... 192/18 A

* cited by examiner

*Primary Examiner*—Emmanuel M Marcelo
(74) *Attorney, Agent, or Firm*—Sherr & Vaughn, PLLC

(57) ABSTRACT

A drawworks having a drum spool, a drum shaft concentrically supported by the drum spool, a rotary union, brake assemblies and a brake cooling system which circulates a cooling fluid through the brake assemblies to thereby reduce the operating temperature of the brake assemblies. The brake cooling system includes a cooling fluid passage that extends through the drum spool, the rotary union and the brake assemblies.

19 Claims, 8 Drawing Sheets

DRAWWORKS HAVING ANNULUS ROTATING UNION WITH BRAKE COOLING SYSTEM

CROSS-REFERENCE TO RELATED APPLICATIONS

Figure 1:
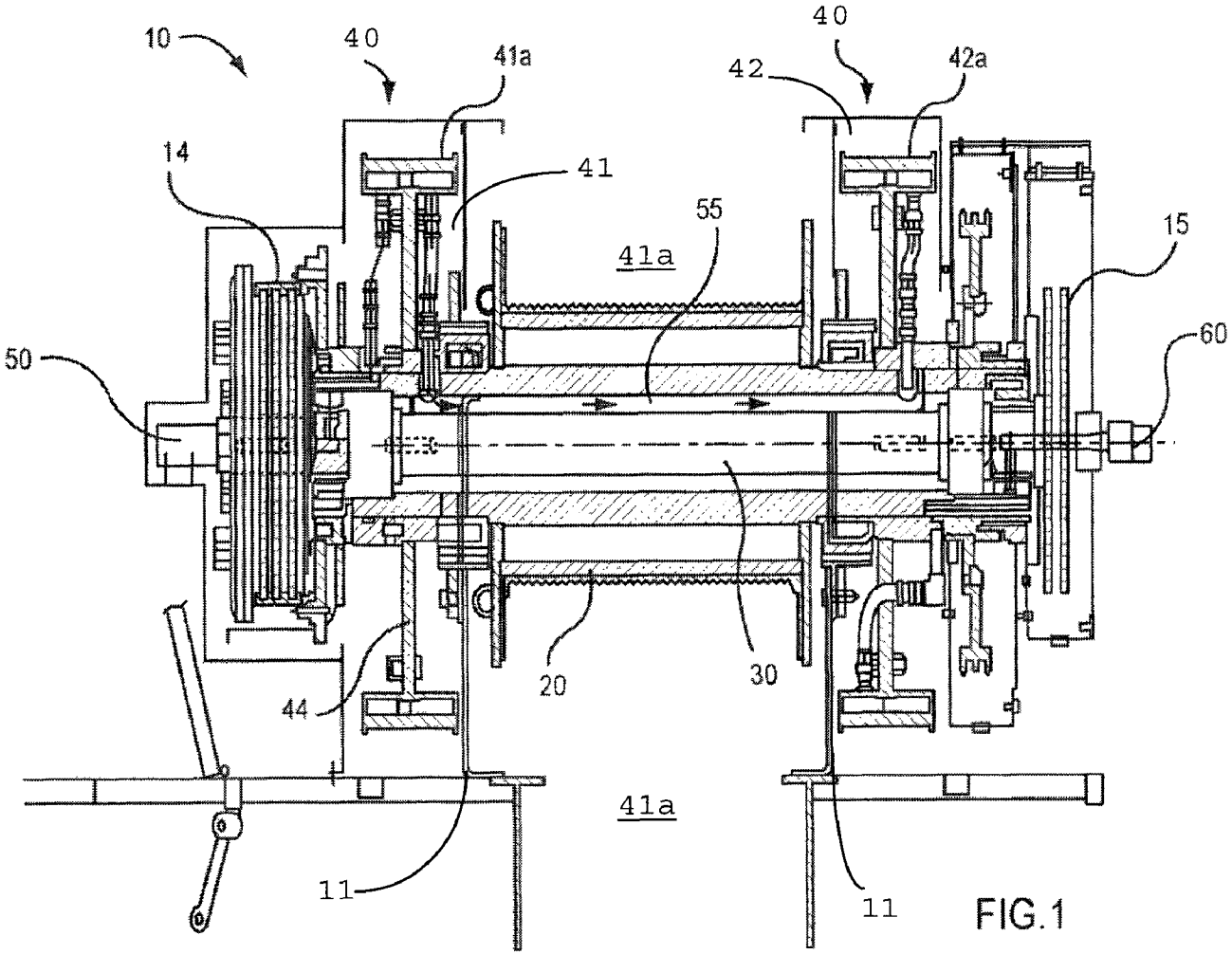

This application claims the benefit of U.S. Provisional Application Ser. No. 61/189,214, filed Aug. 18, 2008.

BACKGROUND

A drawworks apparatus is a type of winch used in the oil well drilling and service industry as a portion of a drilling or servicing rig to raise and/or lower items such as tools, equipment and lengths of pipe from a well bore from which oil or other hydrocarbons are produced.

The drawworks typically includes a large-diameter spool that typically supports a length of cable, a drive system connecting the spool to a power source, one or more brakes and other auxiliary devices that may assist in the lowering and raising items into a well bore. In certain drawworks apparatus, a band brake system having brake flanges mounted located externally on one or both ends of the drum barrel may be used to reduce the rotational speed of the drum barrel.

However, major disadvantages plague conventional drawworks designs. For instance, there is no manner in which to actively cool the brake flanges mounted. Particularly, there is no manner in which to supply a cooling fluid from a rotating union to the brake assembly.

The lack of a cooling system may lead to overheating of the brakes during operation, which in turn, will cause an inordinate amount of wear on the brakes. Such wear will reduce the operating life of the brake assembly, thereby requiring frequent maintenance to either repair and/or replace the brake flanges. Such maintenance leads to increased operating costs.

Moreover, the lack of a cooling system may lead to total mechanical failure of the brake system. Such failure may result in several undesirable consequences. For instance, brake failure during operation of the drawworks may result in the loss of tools, equipment and piping. Secondly, the brake failure will require replacement of the brakes, which, in turn, will require halting the entire drilling operation. Accordingly, the overall operating costs will significantly increase. Even still, the lack of an effective brake cooling system will inevitably reduce the amount of loads the drawworks apparatus may be able to manage due to the increased heat.

SUMMARY

Embodiments relate to a drawworks apparatus having a cooling system for the brake mechanism.

Embodiments relate to a drawworks apparatus having a rotating union mounted on ends of the drumspool in the annulus between drum shaft and the drum barrel of the drum spool.

Embodiments relate to a drawworks apparatus having an annulus rotating union that does not contain any bearings in using adjacent bearings for supporting the drum shaft in the drum barrel.

Embodiments relate to a drawworks apparatus having an internal cooling system for effectively cooling the brake assembly during operation by dissipating heat therefrom.

Embodiments relate to a drawworks apparatus having an internal cooling system that permits heavier loads to be managed without concern for overheating.

Embodiments relate to a drawworks apparatus that utilizes an annulus rotating union having a fluid line fluidically and operatively connected to the brake assembly for supplying a cooling liquid such as water, oil and the like to the brake assembly for effectively cooling the brake assembly during operation.

In accordance with embodiments, a drawworks apparatus may include at least one of the following: a drum spool for raising and lowering items down a well bore via a length of cable wound thereon; a drum shaft which passes through and is rotatably and concentrically supported by the drum spool such that the drum shaft is isolated from wire line pull from the drum spool; a rotating union operatively connected to the drum spool and the drum shaft to permit simultaneous rotation of the drum spool and the drum shaft; a drive mechanism for rotating the drum spool; a brake assembly operatively connected to the main drum spool; and a brake cooling system extending through the rotating union, the drum shaft and the brake assembly for one of lubricating and reducing the operating temperature of the brake assembly during operation of the drawworks apparatus.

In accordance with embodiments, a drawworks apparatus may include at least one of the following: a drum spool for raising and lowering items down a well bore via a length of cable wound thereon; a drum shaft rotatably and concentrically supported by the drum spool; a first brake assembly operatively connected to the main drum spool at an on-operator side of the drawworks assembly; a second brake assembly operatively connected to the main drum spool at an off-operator side of the drawworks assembly; and a brake cooling system having including a cooling fluid line in fluidic communication with the first and second brake assemblies for reducing the operating temperature of the first and second brake assemblies during operation of the drawworks apparatus.

In accordance with embodiments, a drawworks apparatus may include at least one of the following: a drum spool; a drum shaft rotatably and concentrically supported by the drum spool; a first brake assembly operatively connected to the main drum spool at an on-operator side of the drawworks assembly; a second brake assembly operatively connected to the main drum spool at an off-operator side of the drawworks assembly; and a brake assembly cooling system for reducing the operating temperature of the first and second brake assemblies during operation of the drawworks apparatus, the brake assembly cooling system including a cooling fluid line having a first cooling fluid line portion at on-operator side of the drawworks assembly, a second cooling fluid line portion at on-operator side of the drawworks assembly and in fluidic communication with the first cooling fluid line portion, and a third cooling fluid line portion extending between and in fluidic communication with the first and second cooling fluid line portions.

DRAWINGS

Example FIGS. 1-8 illustrate a drawworks apparatus having an annulus rotating union which permits cooling of the braking assembly, in accordance with embodiments.

Figure 2:
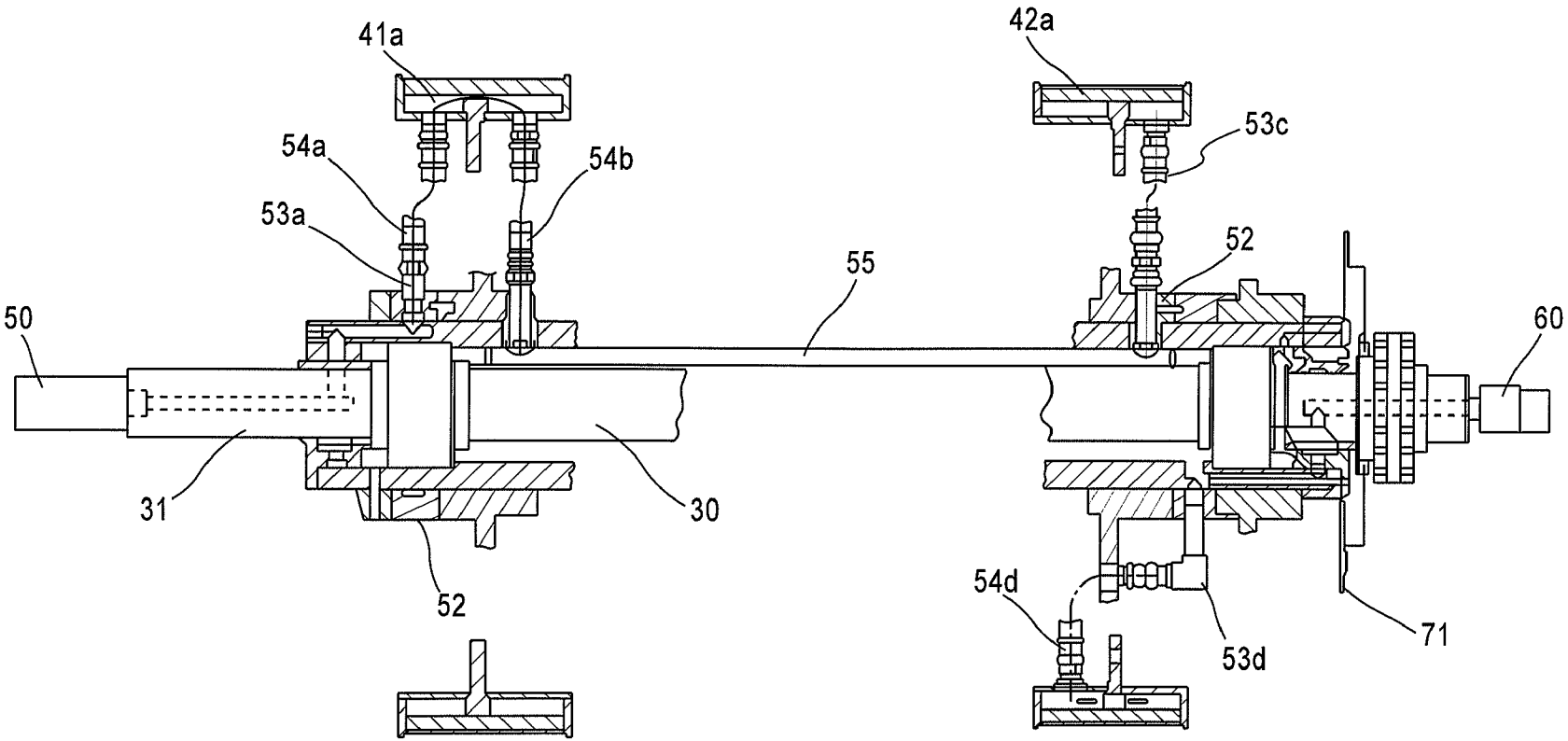

As illustrated in example FIGS. 1 and 2, which illustrate in detail a winch or power transmission apparatus, commonly called a drawworks 10, including frame 11, suitable drive device, drum spool 20, drum shaft 30, brake assembly 40, annulus rotating union 50 and brake cooling system.

Drum spool 20 may be attached to drawworks frame 11 via suitable bearings in a manner permitting rotation of drum spool 20. A suitable length of cable may be wound on drum spool 20 within working area 11*a* of frame 11 to thereby enable drawworks 10 to raise and/or lower tools, equipment, lengths of pipe, etc. from a well bore. Drum shaft 30 is concentrically supported in drum spool 20 and extends longitudinally outward through respective shaft bores thereof.

Drum shaft 30 may be supported in a stationary manner at each end of drum spool 20 via bearings such as anti-friction bearings so as to restrict independent rotation of drum shaft 30 relative to drum spool 20. Meaning, drum spool 20 and drum shaft 30 are adapted to rotate in lock-step together. The anti-friction bearings may be mounted within the bore of drum spool 20 to support drum shaft 30 in a manner which does not restrict rotation. Accordingly, the braking ability of drawworks 10 is not adversely affected by any failure to drum shaft 30 because brake assembly 40 is structurally connected directly to drum spool 20 instead of drum shaft 30 (i.e., drum shaft 30 is structurally isolated from brake assembly 40). Thereby, drum spool 20 is supported by frame 11, and drum shaft 30, in turn, is supported by drum spool 20.

Accordingly, by arranging drum spool 20 to support drum shaft 30, any applied radial load during operation of drawworks 10 may be transmitted back to frame 11. Such a structural configuration and relationship between frame 11, drum spool 20 and drum shaft 30 is advantageous since the braking ability of the drawworks is unaffected by any failure to drum shaft 30 when drawworks 10 is effectuating a hoisting operation.

A suitable drive device may be provided for driving drum spool 20. Drum shaft 30 may support clutch 14 at one end and sprocket 15 at the other end. Thus, the torque necessary to rotate drum spool 20 is input through sprocket 15. It should be understood by those of ordinary skill that any conventional driving device known in the art may be used to drive drum spool 20.

Brake assembly 40 is provided to control the rotational speed of drum spool 20 during the operation of drawworks 10, i.e., when cable is being payed out to lower items. Brake assembly 40 may include first brake assembly 41 operatively connected to drum spool 20 and second brake assembly 42 operatively connected to drum spool 20 and distal to first brake assembly 21. First brake assembly 41 may be operatively connected to drum spool 20 at an on-operator area of drawworks 10 while second brake assembly 42 may be operatively connected to drum spool 20 at an off-operator area. Accordingly, drum spool 20 is provided with a pair of brakes 41, 42 located at each end of frame 11 outside of working area 11*a*. Brake assembly 40 may be a brand brake-type that is operatively connected to drum spool 20 via brake flanges 41*a*, 42*a* mounted outside working area 11*a* of drawworks frame 11. Such band brakes may serve to effectively reduce the rotational speed of drum spool 20, and in turn, control the rate at which the length of cable from drum spool 20 is payed out. The mounting of brake flanges 41*a*, 42*a* may be accomplished via spider 44 with keyed hub 45. In accordance with embodiments, brake flanges 41*a*, 42*a* may include a cooling fluid jacket for receiving a cooling fluid to enable such cooling fluid to be circulated throughout brake assembly 40.

Annulus rotating union 50 and rotary union 60 are provided at both ends of drum shaft 30 to enable joint rotation between drum spool 20 and drum shaft 30 during a hoisting operation of drawworks 10. Annulus rotating union 50 may be mounted in the annulus between drum shaft 20 and the drum barrel of drum spool 20. Annulus rotating union 50 does not contain any bearings since it makes use of adjacent bearings used to support drum shaft 30 in drum spool 20. When it is necessary to remove items such as tools, equipment or piping from the well bore, the clutch is disengaged permitting lock-step rotation of drum spool 20 and drum shaft 30. Cable and the traveling block attached thereto travels downwardly within the well bore. During this downward travel, it is necessary to have an annulus rotating union that enables a cooling fluid to circulate to the jacketed brake flanges 41*a*, 42*a*.

Rotary union 60 may be received into hole placed axially at the distal end of drum shaft 30. Such a hole may be threaded in order that corresponding threads of rotary union 60 may be received by screwing rotary union 60 into the hole. The hole may be formed at a depth to permit a second hole to be formed in drum shaft 30 extending perpendicular with respect to the first hole. From an axial perspective, the second hole may be located within an inner diameter of the drum barrel.

As illustrated in example FIGS. 3-8, in accordance with embodiments, annulus rotating union 50 is part of the brake cooling system which enables circulation of a cooling fluid such as water, oil and the like through at least the cooling fluid jacket of brake assembly 40 to thereby reduce the operating temperature of brake assembly 40.

Figure 7A:
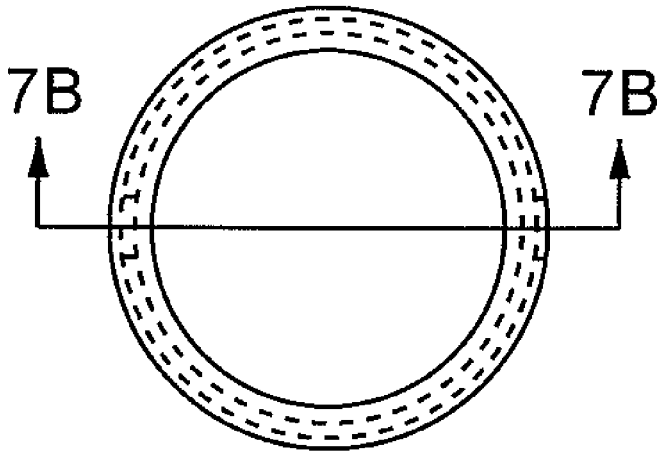
Figure 7B:
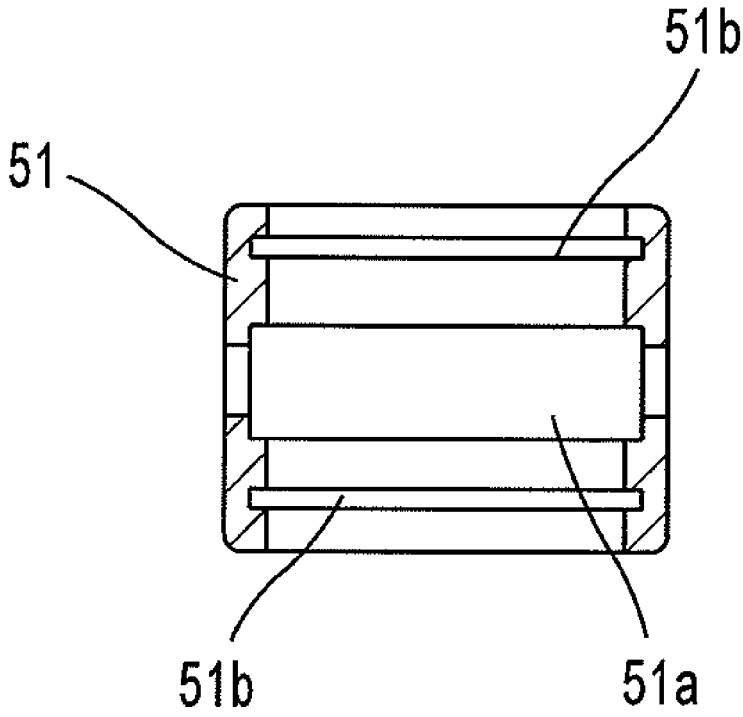
Figure 8A:
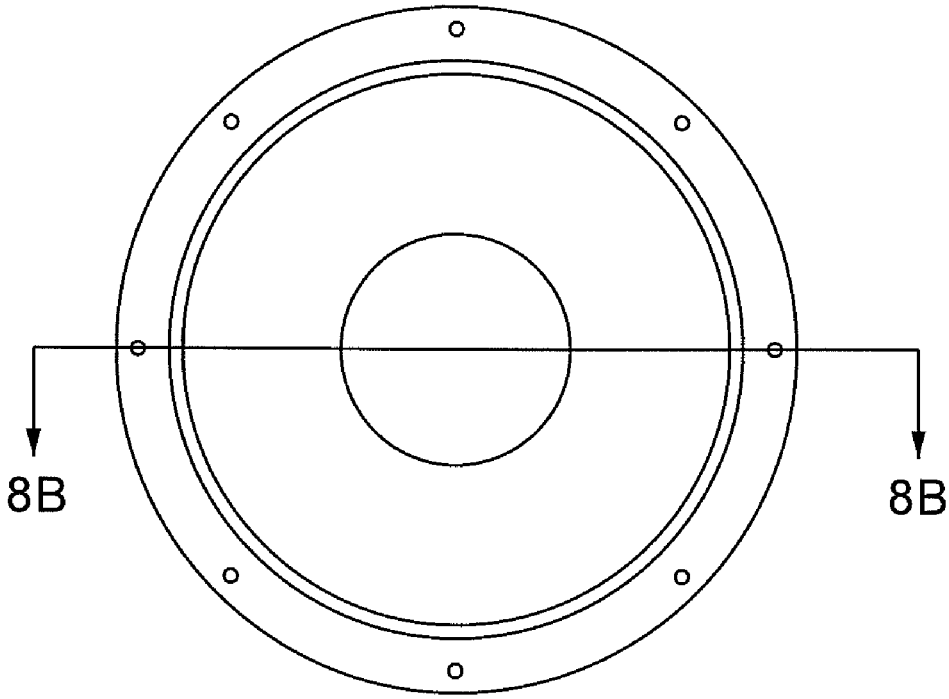
Figure 8B:
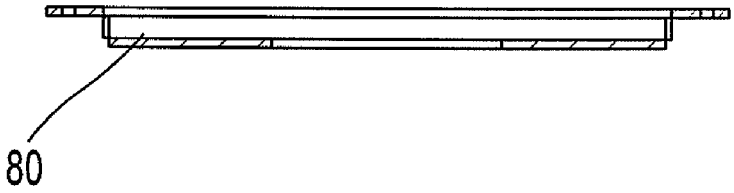

As illustrated in example FIG. 7, at both on and off operating regions, seal spacer 51 may be mounted concentrically on and in fluidic communication with drum shaft 30 at an outlet end of drum shaft cooling fluid passage 31 of drum shaft 30. Seal spacer 51 may have a first brake cooling fluid groove 51*a* permitting a flow of the brake cooling fluid therethrough. O-ring grooves 51*b* may be provided at an inner surface of seal spacer 51 and sized to receive corresponding O-rings adapted to provide a fluid-tight seal at a cooling fluid passage. Seal spacer 51 may include an inlet groove fluidically connected to the second end of the drum shaft cooling fluid passage 31 and a plurality of outlet grooves in fluidic communication with brake assembly 40. An cooling fluid outlet hole may be provided extending perpendicular to the longitudinal axis of seal spacer 51.

Figure 5A:
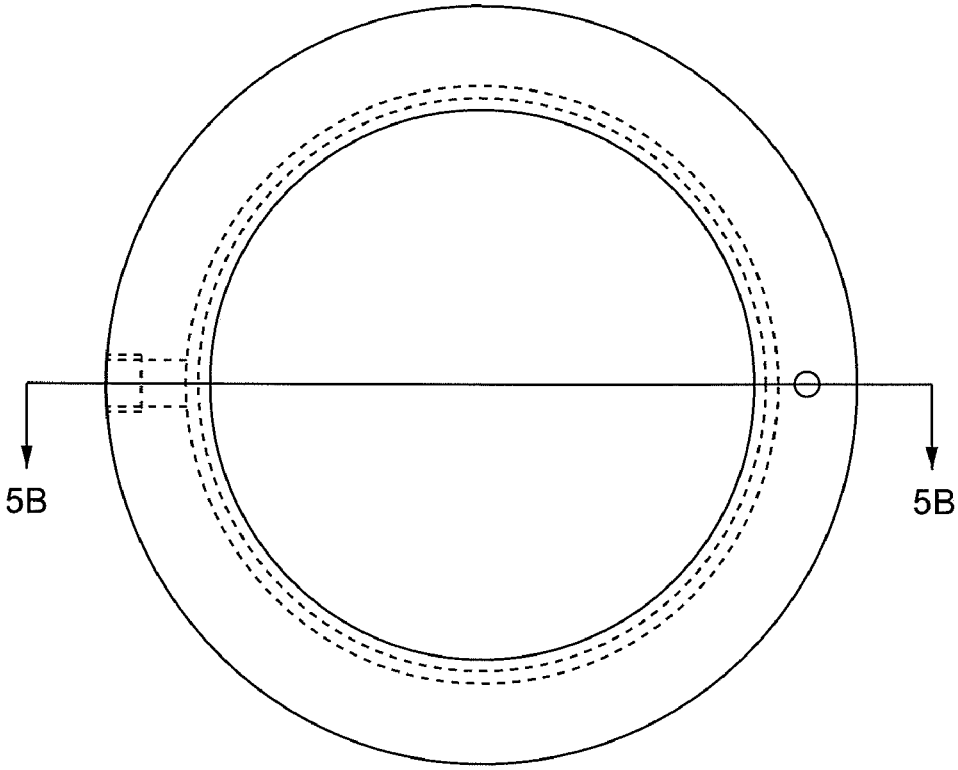
Figure 5B:
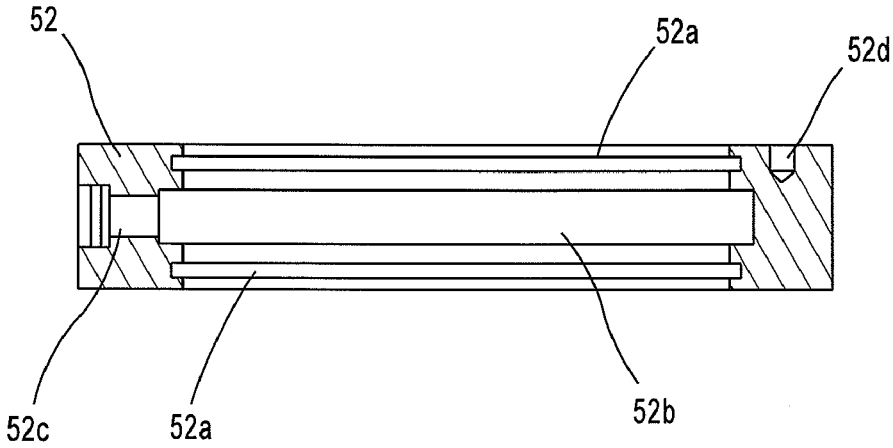
Figure 6A:
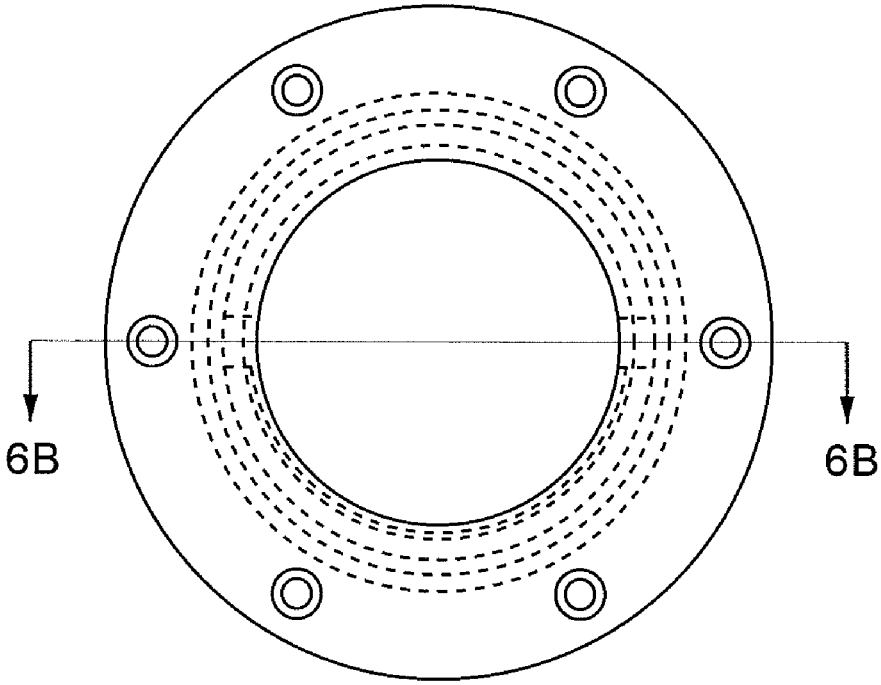
Figure 6B:
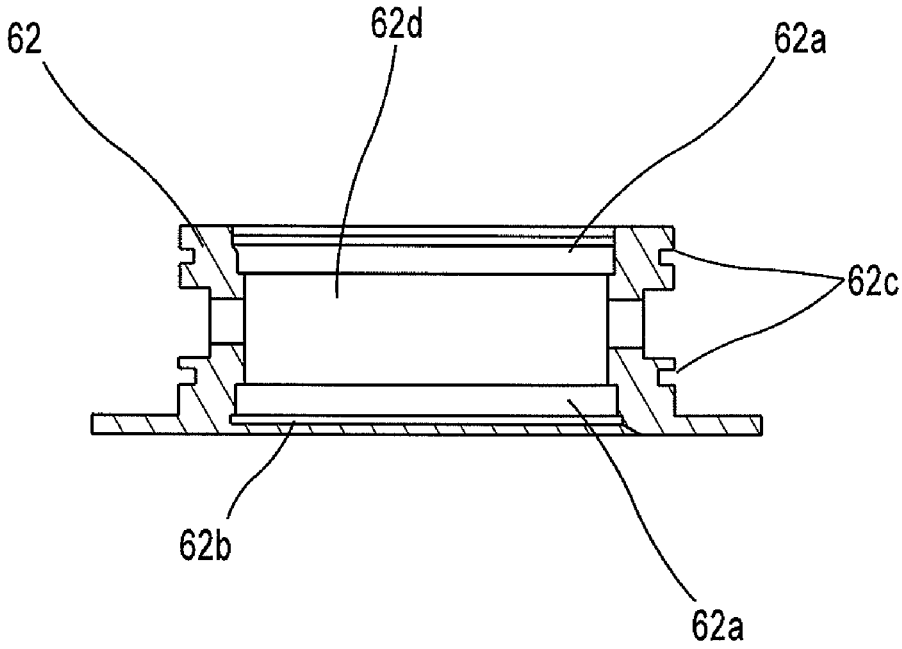

As illustrated in example FIGS. 5 and 6, a plurality of gland arrangements are provided in order to seal working areas adjacent the cooling fluid passageway. As illustrated in example FIGS. 2 and 5, first gland 52 is provided in brake flange spider 44 and mounted concentrically on an outer circumferential surface of drum spool 20 at the on-operator region and the off-operator region. First gland 52 may include one or more recesses 52*a* at an inner surface thereof for receiving O-rings which define a cooling fluid passage 52*b* having an outlet hole 52*c* permitting fluid flow from second gland 52. A dowell pin hole 52*d* is provided at one side of first gland 52 sized to receive a dowell pin which prevents rotation of first gland 52 relative to drum spool 20.

As illustrated in example FIG. 6, second gland 62 may be mechanically attached to both axial ends of drum spool 20. Second gland 62 may be provided with one or more seal recesses 62*a* spaced apart at an inner surface thereof for holding the seals in position, a groove 62*b* at an inner surface thereof for receiving a retaining ring, and one or more grooves 62*c* at an outer surface thereof for receiving one or more O-rings to provide a sealing interface. The seal recesses define a cooling fluid passage 62*d*. Second gland 62 located at the off-operator region of drawworks 10 may be provided with a weep hole permitting drainage of cooling fluid during an instance of seal failure.

Figure 3:
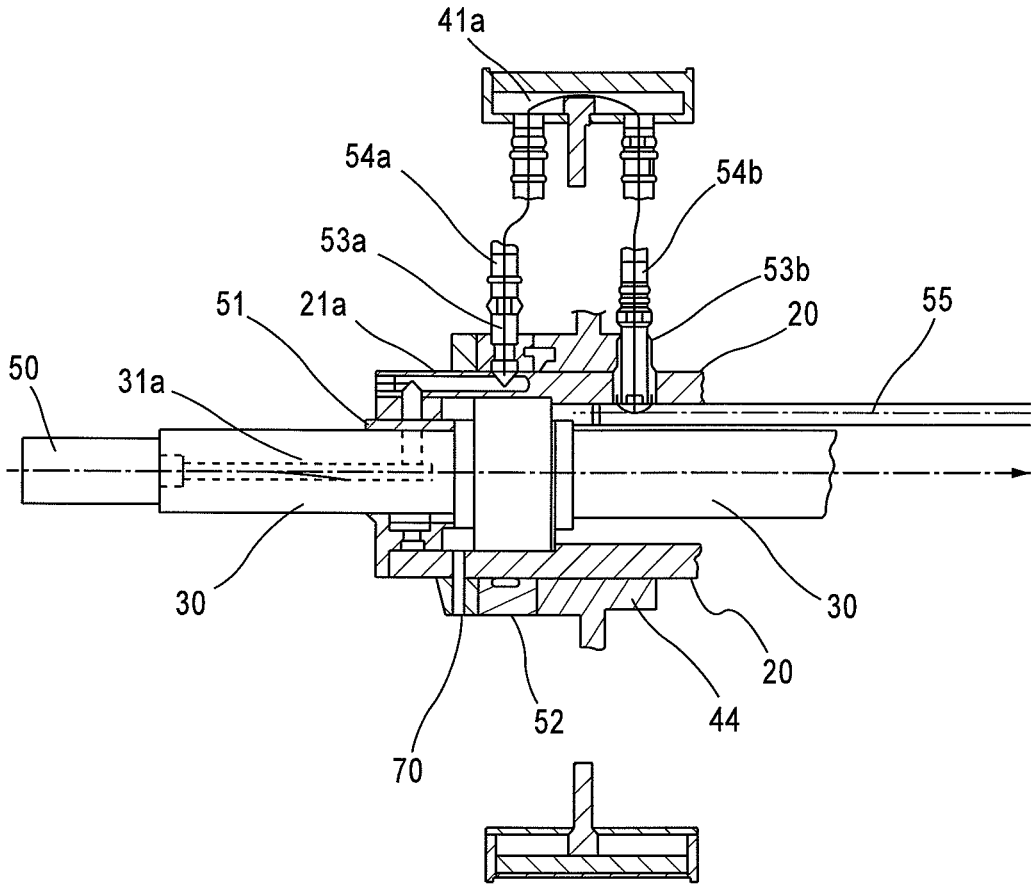
Figure 4:
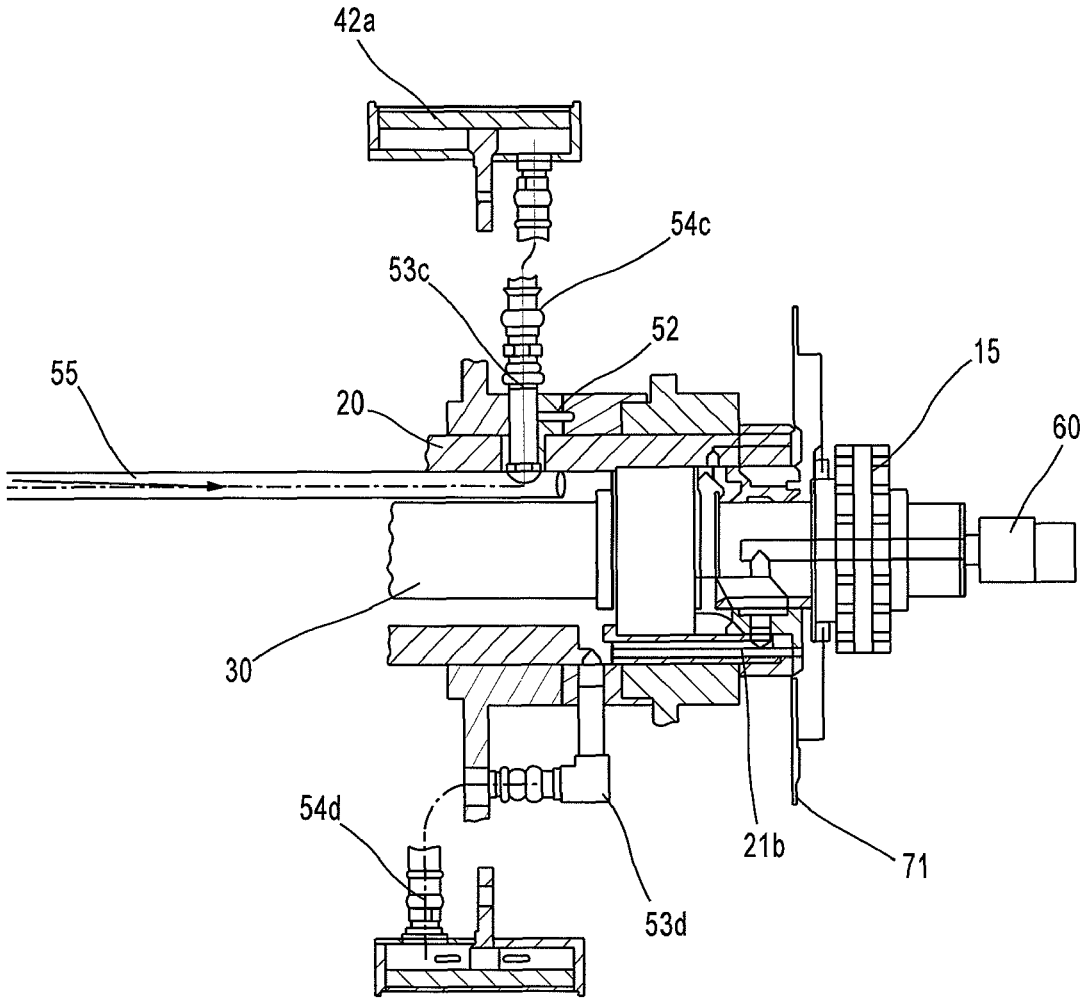

As illustrated in FIGS. 2 to 4, In operation, a cooling fluid such as water, oil and the like flows from a cooling fluid supply into an inlet of rotating union 50. The cooling fluid exits an outlet of rotating union 50 and enters a cooling fluid passage 31*a* of drum shaft 30. Exiting cooling fluid passage 31*a* the cooling fluid flows through cooling fluid groove 51*a* of seal spacer 51 exits the plurality of outlet grooves and into cooling fluid groove 52*a* of seal carrier 52 which is mounted concentrically on and in fluidic communication with seal spacer 51. The cooling fluid thereby flows from seal carrier 52 and into cooling fluid passage 21*a* of drum spool 20.

In fluidic communication with cooling fluid passage 21*a* is gland 52, which receives the cooling fluid therefrom. Gland 52 is in fluidic communication with pipe adapter 53*a* which is received by gland 52 in order to permit circulation of the cooling fluid therethrough. The cooling fluid flows through pipe adapter 53, into hose 54*a* and then into the cooling fluid jacket of brake flange 41*a*. In accordance with embodiments, the water jacket of brake flanges 41*a*, 42*a* are designed in a manner to permit full circulation of the cooling fluid therethrough in order to cool (i.e., reduce the temperature) the surfaces of the brake flange 41*a*.

The cooling fluid exits the brake flange 41*a* through hose 54*b* and flows through pipe adapter 53*b* and into manifold 55 which is interposed between and extends parallel to drum spool 20 and drum shaft 30. The cooling fluid flows from pipe manifold 55 and enters a cooling fluid passage in drum spool 20 at the off-operator side of drawworks 10. the cooling fluid exits drum spool 20 and flows through pipe adapter 53*c*, hose 54*c* and enters the cooling fluid jacket of brake flange 42*a*. As with the on-operator side of drawworks 10, the cooling fluid circulates through the cooling fluid jacket therethrough in order to cool (i.e., reduce the temperature) the surfaces of the brake flange 42*a*.

The cooling fluid exits the brake flange 42*a* and flows sequentially through hose 54*d*, pipe adapter 53*d* and gland 52 where it enters cooling fluid hole 21*b* of drum spool 20. From cooling fluid hole 21*b* the cooling fluid flows into the circulating chamber formed by spring-loaded lip seal which rides on seal spacer 51 and mounted in seal carrier. The cooling fluid exits the circulating chamber and enters the cooling fluid passage groove of seal spacer through a plurality of holes. From the cooling fluid passage groove, the cooling fluid enters the cooling fluid passage hole 31*b* of drum shaft 30 and then passes through rotary union 60 where it then flows into a cooling fluid storage chamber or cooling fluid supply.

In order to provide a visual indication of when maintenance should be performed on seals, weep holes 70, 71 are provided at the on-operator and off-operator regions of drawworks 10. Drain or weep holes 70, 71 permit the drainage of the cooling fluid instances where seal leakage occurs. Such drainage indicates than one or more seals should be maintained and/or replaced. As illustrated in example FIG. 8, the off-operator region may include a cooling fluid trapping catcher/drain 80 formed by a catcher and closed-cell neoprene seal. Catcher/drain 80 is concentrically mounted on drum shaft 30 and may be provided with a weep hole 71 at its lowest most point to prevent build up of the cooling fluid and thereby permits proper drainage of the cooling fluid.

In accordance with embodiments, rotating union 60 may include seal spacer 51 mounted on drum shaft 30 and gland mounted on the extended drum barrel of drum spool 20, at least one of gland arrangement 52, 62 and seals installed in the gland arrangement 52, 62 with a sealing surface running on the seal spacer 51. The sealing surface of seal spacer 51 may be composed of an elastomeric material. Accordingly, rotating union 60 in accordance with embodiments routes cooling fluid from a drilled hole in drum shaft 30 to a cooling fluid passage in drum spool 20.

In accordance with embodiments, a drawworks having an annulus rotating union mounted on ends of the drum spool may be equipped with an internal brake cooling system that circulates a cooling liquid such as water, oil and the like to the brake assembly for effectively cooling the brake assembly during operation prevents. Such a cooling system prevents overheating of the brake assembly. Accordingly, the drawworks is capable of handling heavier loads without concern for overheating of the brake assembly. Such features may thereby significantly reduce overall operating and maintenance costs.

Although embodiments have been described herein, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A drawworks apparatus comprising:

a frame having a working area within inner surfaces thereof;

a drum spool for raising and lowering items down a well bore via a length of cable wound thereon, the drum spool extending through and rotatably supported by the frame outside the working area thereof;

a drum shaft concentrically supported by the drum spool in a manner in which the drum shaft is isolated from wireline pull from the drum spool;

a seal spacer mounted concentrically on the drum shaft to provide a hermetic seal at an interface between the seal spacer and the drum shaft;

an annulus rotating union provided at each distal end of the drum spool to permit the drum spool to rotate independently relative to the drum shaft;

a brake assembly operatively connected to the drum spool and located outside of the working area;

a brake assembly cooling system including a cooling fluid line in fluidic communication with a cooling fluid supply and extending continuously through the drawworks apparatus including the drum spool, the drum shaft, the brake assembly and the annulus rotating union for reducing the operating temperature of the brake assembly during operation of the drawworks apparatus; and a cooling fluid manifold extending axially in a spatial gap between the drum spool and the drum shaft and continuously through the working area, the cooling fluid manifold being in fluidic communication with the drum shaft, the drum spool and the brake assembly, wherein the cooling fluid line comprises a drum shaft cooling fluid passage extending through the drum shaft and includes a first end in fluidic communication with the annulus rotating union and a second end in fluidic communication with the brake assembly, the cooling fluid manifold, and a seal spacer groove permitting a flow of cooling fluid through the seal spacer.

2. The drawworks apparatus of claim 1, wherein the seal spacer groove includes an inlet groove in fluidic communication with the second end of the drum shaft cooling fluid passage and a plurality of outlet grooves in fluidic communication with the brake assembly.

3. The drawworks apparatus of claim 1, further comprising:

a seal carrier mounted concentrically on and in fluidic communication with the seal spacer, the seal carrier having a second brake cooling fluid groove permitting the flow of the brake cooling fluid therethrough and O-rings adapted to provide a hermetic seal at an interface between the seal carrier and the drum spool.

4. The drawworks apparatus of claim 3, further comprising:

lip seals mounted spaced apart in the seal carrier to define a brake cooling fluid chamber; and retaining rings adapted to mount the lip seals in the seal carrier.

5. The drawworks apparatus of claim 1, wherein the brake assembly comprises a band brake.

6. The drawworks apparatus of claim 5, wherein the band brake is connected to the main drum spool via brake flanges mounted outside a working area of the drawworks apparatus, the brake flanges having a cooling fluid jacket for receiving the cooling fluid and circulating the cooling fluid throughout the brake assembly.

7. A drawworks apparatus for raising and lowering items down a well bore, the drawworks apparatus comprising:

a frame having a working area within inner surfaces thereof where the raising and lowering of items occurs;

an annulus rotating union operatively connected to the drum spool to permit independent rotation of the drum spool relative to the drum shaft, the annulus rotating union having a cooling fluid inlet which receives a cooling fluid and a first cooling fluid passage in fluidic communication with the cooling fluid inlet;

a drum shaft which is adapted to receive the annulus rotating union, the drum shaft having a second cooling fluid passage in fluidic communication with the first cooling fluid passage;

a seal spacer mounted concentrically on the drum shaft to provide a hermetic seal at an interface between the seal spacer and the drum shaft, the seal spacer having a third cooling fluid passage in fluidic communication with the second cooling fluid passage;

a first brake assembly located outside of the working area, the first brake assembly having a fourth cooling fluid passage in fluidic communication with the third cooling fluid passage;

a drum spool operatively connected to the first brake assembly at an on-operator area of the drawworks assembly and which is rotatably supported by the frame and concentrically supports the drum shaft, the drum spool having a fifth cooling fluid passage in fluidic communication with the fourth cooling fluid passage; and a cooling fluid manifold extending axially in a spatial gap between the drum shaft and the drum spool and in fluidic communication with the fifth cooling fluid passage.

8. The drawworks apparatus of claim 7, further comprising:

a second brake assembly located outside of the working area and operatively connected to the drum spool at an off-operator area of the drawworks assembly, the second brake assembly having a sixth cooling fluid passage in fluidic communication with the brake cooling fluid manifold.

9. The drawworks apparatus of claim 8, wherein the cooling fluid manifold, the first, second, third, fourth, fifth and sixth cooling fluid passages comprise a brake assembly cooling system which is adapted to reduce the operating temperature of the first and second brake assemblies during operation of the drawworks apparatus.

10. The drawworks apparatus of claim 8, wherein the seal spacer includes a plurality of outlet grooves in fluidic communication with the first brake assembly.

11. The drawworks apparatus of claim 7, wherein the seal spacer includes an inlet groove in fluidic communication with the second cooling fluid passage.

12. The drawworks apparatus of claim 7, further comprising:

a seal carrier mounted concentrically on and in fluidic communication with the seal spacer, the seal carrier having a seal carrier groove which permits a flow of the cooling fluid therethrough and O-rings adapted to provide a hermetic seal at an interface between the seal carrier and the drum spool.

13. The drawworks apparatus of claim 12, further comprising:

lip seals mounted spaced apart in the seal carrier to define a cooling fluid chamber; and retaining rings adapted to mount the lip seals in the seal carrier.

14. A drawworks apparatus comprising:

a frame having a working area within inner surfaces thereof where raising and lowering of items down a well bore occurs;

a drum spool extending through and rotatably supported by the frame;

a drum shaft concentrically supported by the drum spool;

a rotating union operatively connected to the drum spool to permit independent rotation of the drum spool relative to the drum shaft;

a seal spacer mounted concentrically on the drum shaft and adapted to provide a hermetic seal at an interface between the seal spacer and the drum shaft;

a brake assembly located outside the working area and operatively connected to the drum spool;

a brake assembly cooling system adapted to reduce the operating temperature of the brake assembly during operation of the drawworks apparatus, the brake assembly cooling system including:

a rotating union cooling fluid inlet at the rotating union which receives a cooling fluid and a rotating union cooling fluid passage in fluidic communication with the rotating union cooling fluid inlet;

a drum shaft cooling fluid passage extending through the drum shaft and in fluidic communication with the rotating union cooling fluid passage;

a seal spacer cooling fluid passage extending through the seal spacer and in fluidic communication with the drum shaft cooling fluid passage;

a brake assembly cooling fluid passage extending through the brake assembly and in fluidic communication with the seal spacer cooling fluid passage;

a drum spool cooling fluid passage extending through the drum spool and in fluidic communication with the brake assembly cooling fluid passage; and a cooling fluid manifold extending axially between the drum spool and the drum shaft and in fluidic communication with the drum spool cooling fluid passage.

15. The drawworks apparatus of claim 14, wherein the seal spacer cooling passage comprises an inlet groove in fluidic communication with the drum shaft cooling fluid passage and a plurality of outlet grooves in fluidic communication with the brake assembly cooling fluid passage.

16. The drawworks apparatus of claim 14, further comprising:

a seal carrier mounted concentrically on and in fluidic communication with the seal spacer, the seal carrier having a seal carrier brake cooling fluid passage which and O-rings adapted to provide a hermetic seal at an interface between the seal carrier and the drum spool.

17. The drawworks apparatus of claim 16, further comprising:

lip seals mounted spaced apart in the seal carrier to define a brake cooling fluid chamber; and retaining rings adapted to mount the lip seals in the seal carrier.

18. The drawworks apparatus of claim 14, wherein the brake assembly is connected to the main drum spool via brake flanges.

19. The drawworks apparatus of claim 14, wherein the brake flanges includes a cooling fluid jacket for receiving the cooling fluid and permitting the circulation thereof throughout the brake assembly.

* * * * *